United States Patent [19]

Shaw et al.

[11] Patent Number: 4,556,765

[45] Date of Patent: Dec. 3, 1985

[54] SECURITY INTERFACE SYSTEM FOR A DOOR, WINDOW OR THE LIKE

[75] Inventors: Arthur W. Shaw, Syosset; Isadore Gepner, Elmont, both of N.Y.

[73] Assignee: Pittway Corporation, Syosset, N.Y.

[21] Appl. No.: 494,269

[22] Filed: May 13, 1983

[51] Int. Cl.[4] ..... H01H 3/16

[52] U.S. Cl. ..... 200/61.71; 200/61.73; 200/61.74; 200/275; 340/545

[58] Field of Search ..... 200/61.62, 61.71, 61.76, 200/61.93, 61.73, 61.74, 61.81, 61.82, 61.72, 275, 282, 61.75; 340/549, 545

[56] References Cited

U.S. PATENT DOCUMENTS

| | | | |
|---|---|---|---|
| 2,912,540 | 11/1959 | Sawicki | 200/87 |
| 3,567,882 | 3/1971 | Beck | 200/61.93 |
| 3,569,645 | 3/1971 | Lea | 200/61.62 |
| 3,668,579 | 6/1972 | Herman | 335/207 |
| 3,694,595 | 9/1972 | Horecky | 200/61.76 |
| 4,035,596 | 7/1977 | Marquardt et al. | 200/275 X |
| 4,151,382 | 4/1979 | Kaufman et al. | 200/61.74 X |
| 4,210,888 | 7/1980 | Holce | 335/207 |
| 4,213,110 | 7/1980 | Holce | 335/207 |
| 4,392,707 | 7/1983 | Holce et al. | 200/61.71 X |

OTHER PUBLICATIONS

"Foil Take-Off Contact Switch", Ademco 379, (Catalog page and installation instruction sheet).

*Primary Examiner*—James L. Rowland
*Assistant Examiner*—Thomas J. Mullen, Jr.

[57] ABSTRACT

A contact unit for use in a security system for monitoring a structural opening such as a door or a window. The contact unit includes a housing of electrically insulation material, and an elongated resilient electrically conductive member that has one end fixed to the housing with an intermediate portion of the conductive member protruding through an opening in the housing. The protruding intermediate portion of the conductive member includes first and second angularly offset sections with a contact surface at the junction of the two sections for engagement by an electrically conductive actuator. The second section of the protruding portion is disposed adjacent fixed structure in the housing such that the second section willingly engages and is flexed by that fixed structure as the contact surface is moved towards the housing. This flexing interaction progressively increases the resistance of the conductive member to movement into the housing, with accompanying increase in contact pressure between the conductive member and the actuator.

14 Claims, 14 Drawing Figures

SECURITY INTERFACE SYSTEM FOR A DOOR, WINDOW OR THE LIKE

This invention relates to security systems and more particularly to monitoring systems of the type used to provide protection for doors, windows and similar movable closures for structural openings.

A number of reliable and efficient closure monitoring systems have been developed and are in use in providing electrical protection against intruders using doors, windows and similar openings. Such monitoring systems typically include cooperating contact units which include a set of mechanically or magnetically operated contacts for completing an electrical circuit and are arranged to operate a relay or otherwise generate an alarm signal when the structural closure such as a door or window which the set of contact units is monitoring is opened. Among the objects of this invention is to provide a novel and improved closure monitoring system of that type.

In accordance with one aspect of the invention, there is provided a contact unit for use in a security system for monitoring a structural opening such as a door or a window. The contact unit includes a housing of electrically insulating material, and an elongated resilient electrically conductive member that has one end fixed to the housing with an intermediate portion of the conductive member protruding through an opening in the housing. In a preferred embodiment, means in the housing restrains the conductive member in prestressed condition. The protruding intermediate portion of the conductive member includes first and second angularly offset sections with a contact surface at the junction of the two sections for engagement by an electrically conductive actuator. The second section of the protruding portion is disposed adjacent fixed structure in the housing such that the second section wipingly engages and is flexed by that fixed structure as the contact surface is moved towards the housing. This flexing interaction progressively increases the resistance of the conductive member to movement into the housing, with accompanying increase in contact pressure between the conductive member and the actuator.

In accordance with another aspect of the invention, there is provided a contact unit for use in a security system for monitoring a structural opening such as a door or a window that includes a contact member of electrically conductive material that has two parallel flanges connected by a planar coupling portion, and a housing of electrically insulating material. The housing defines a compartment and has two planar exterior walls disposed at right angles to one another, and a third exterior wall that has an opening for a terminal connection. A slot through the planar exterior wall adjacent the third wall receives one of the flanges of the contact member so that when that flange is disposed in the compartment adjacent the opening, the other flange is adjacent one of the planar walls and the planar coupling portion is adjacent the other planar wall. Preferably, each of the planar walls has a recess that receives the other flange and the coupling portion such that their outer surfaces are slightly below the plane of the faces of the planar walls. A terminal connector for connecting the contact member to external circuitry cooperates with structure in the compartment to fixedly secure the contact member to the housing.

In a particular embodiment, a closure monitoring system includes two cooperating contact units, the housing of each cooperating contact unit being of molded plastic material and defining two compartments, each of which has an opening for a terminal connection to which is connected an electrically conductive contact member. Each terminal connection is disposed in a recess that has a cylindrical portion and a relatively narrow elongated portion that extends away from the cylindrical portion. A connector member of the screw type and that has an enlarged head portion is disposed in the cylindrical portion of each recess such that a connector component secured under the screw head is guided by and contained within the cylindrical recess wall that extends around the perimeter of the screw head, with the relatively narrow elongated portion that extends away from the cylindrical portion providing supplemental guidance for the connector conductor.

Structure in each compartment in one contact unit defines a post and a wiping surface spaced from the post and cooperates with a spring strip type of electrically conductive contact member that has first and second legs connected by a bight. The first leg of each spring strip is connected to a terminal screw and the second leg of each spring strip is bifurcated and each bifurcated portion has two angularly offset portions with a contact surface at the junction for engagement by a fixed contact surface of the cooperating contact unit. Each spring strip is disposed in a corresponding compartment of the housing with the first leg fixedly connected to the terminal screw, the bight extending around the post structure, the two contact surfaces in aligned position outside the housing, and with a tip portion of each bifurcated portion in restrained engagement adjacent the wiping surface, providing effective prebiasing of the spring strip and protection against excessive stress as a result of routine activities such as day to day cleaning around a door or window installation.

The housing of the other contact unit also has two compartments, each of which receives a contact member that has two parallel flanges connected by a planar coupling portion. Two planar exterior walls of that housing are disposed at right angles to one another, and each planar exterior wall has two recesses therein. A third exterior wall has an opening for a screw-type terminal connection, and each compartment has a slot through the planar exterior wall adjacent the third wall. Each slot receives one of the flanges of a corresponding contact member so that one flange extends into a compartment, with the other flange disposed in a recess in the one of the planar walls and the planar coupling portion disposed in a recess in an adjacent planar wall, the outer surfaces of the portions of the contact members disposed in the recesses being slightly below the plane of the faces of the planar walls and spaced for alignment with corresponding contact surfaces of said two spring strips of the other contact unit. Each terminal screw is threaded into the contact flange that extends through the compartment slot and fixedly secures the planar surfaces of the contact member in position in their respective recesses.

When the two contact units are secured in juxtaposed mating position to fixed and movable components of a structural opening, and the monitored opening is closed, planar contact surfaces of the second contact unit engage the dual contact surfaces of the corresponding spring strips of the first contact unit and move those strip contact surfaces towards the housing. As the dual contact surfaces of each spring strip are moved towards their housing, wiping and flexing interactions of bifurcated portions of the spring strips and fixed housing structure and bight—post interactions progressively increase the resistance of the spring strips to movement into the housing, with accompanying increase in wiping interactions between the planar contact surfaces of the second contact unit and the dual contact surfaces of the corresponding spring strips of the first contact unit. These interactions produce reliable completion of electrical circuits between the terminal connector screws when the monitored opening is in closed position.

Other features and advantages of the invention will be seen as the following description of a particular embodiment progresses, in conjunction with the drawings, in which.

DESCRIPTION OF PARTICULAR EMBODIMENT

Figure 1:
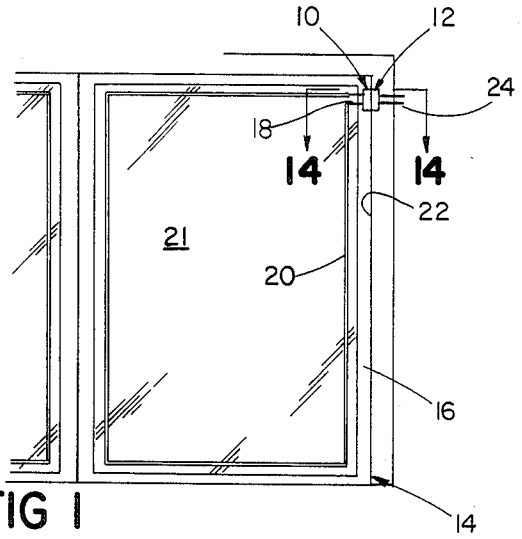
FIG. 1 is a diagram showing a security system contact unit installation in accordance with the invention.

Shown in FIG. 1 is an installation of contact units 10, 12 for monitoring sliding door 14. Contact unit 10 is mounted on the sliding door frame 16 and is connected via wires 18 to the terminals of foil conductor strip 20 on the glass door panel 21. Contact unit 12 is mounted on the fixed jamb 22 and is connected to wires 24 that are connected to a remote alarm device (not shown). Unit 10 includes a pair of biased contacts and unit 12 includes a pair of fixed contacts. The two contact units are mounted parallel to each other and in alignment so that the pairs of contacts complete an electrical circuit between foil conductor 20 and alarm wires 24 when the door is closed. That circuit is interrupted whenever the foil conductor 20 is broken or the door is opened.

Figure 2:
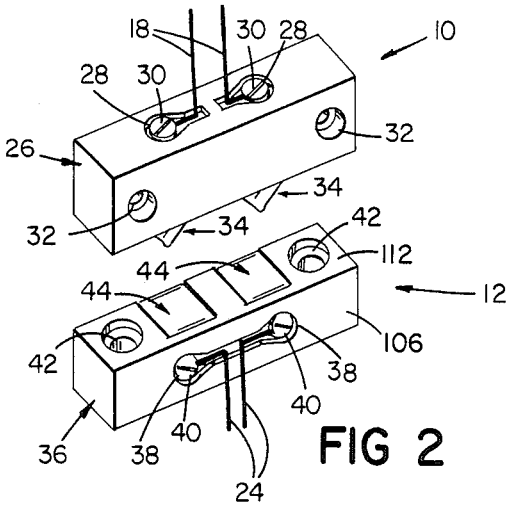
FIG. 2 is a perspective view of the cooperating contact units in the system shown in FIG. 1.

Further details of the two cooperating contact units 10, 12 may be seen with reference to FIG. 2. The housing 26 of unit 10 has recesses 28 (each recess having a narrow elongated portion 27 and an enlarged portion 29) in which are disposed terminal screws 30 to which wires 18 are connected; through holes 32 adapted to receive screws for mounting; and two spring contact members 34. The housing 36 of base unit 12 has similar recesses 38 which house terminal screws 40; through holes 42 adapted to receive screws for mounting; and fixed contact members 44 spaced corresponding to the spacing of spring contact strips 34 of unit 10.

Further details of contact unit 10 may be seen with reference to FIGS. 3-7. That unit has a molded plastic housing 26 that is about 6.2 centimeters long; about 1.6 centimeter high; and about 1.3 centimeters deep; and that includes base member 46 and cover 48 that are welded together. Base 46 has integral divider 50 such that two similar compartments 52 are defined. Post member 54 in each compartment 52 defines through hole 32. Formed on each post member 54 is support surface 56 and projection 58. Also within each compartment 52 are two intersecting webs 60, 62, web 60 extending from post 54 to web 62 at a point just below the end 64 of that web. Web 62 extends parallel to divider web 50 and provides a support surface 66 at the end opposite tip 64 that is aligned with surface 56. Formed in the base wall of each compartment 52 is an aperture that is bounded by end surfaces 68, 70 with each end surface 70 spaced about one millimeter from tip 64. The opposite wall 72 of housing 26 (in which terminal recesses 28 are formed) provides retaining surfaces that overlie seat surfaces 56, 66. Central tab 74 defines the end boundaries of recess portions 27. Disposed on each pair of seats 56, 66 and retained by overlying surfaces of wall 72 is a contact assembly 78 (FIG. 7) that includes brass terminal plate 80, phosphor bronze spring strip 34 and terminal screw 30.

Figure 7:
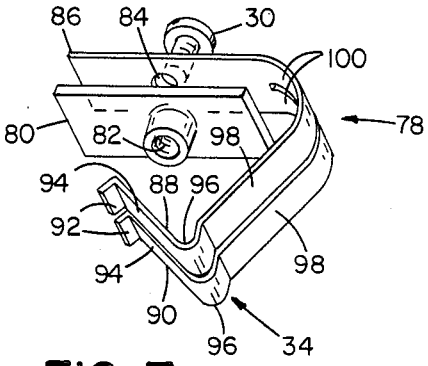
FIG. 7 is a perspective view of a conductor strip assembly employed in the contact unit of FIG. 3.
Figure 3:
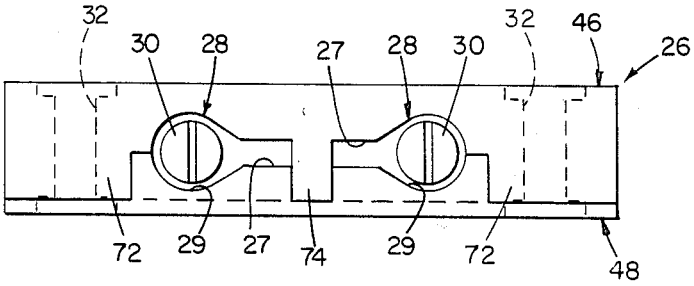
FIG. 3 is a top view of one of the contact units.
Figure 6:
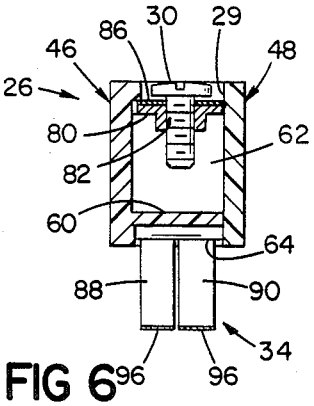
FIG. 6 is a sectional view taken along the line 6—6 of FIG. 4.
Figure 13:
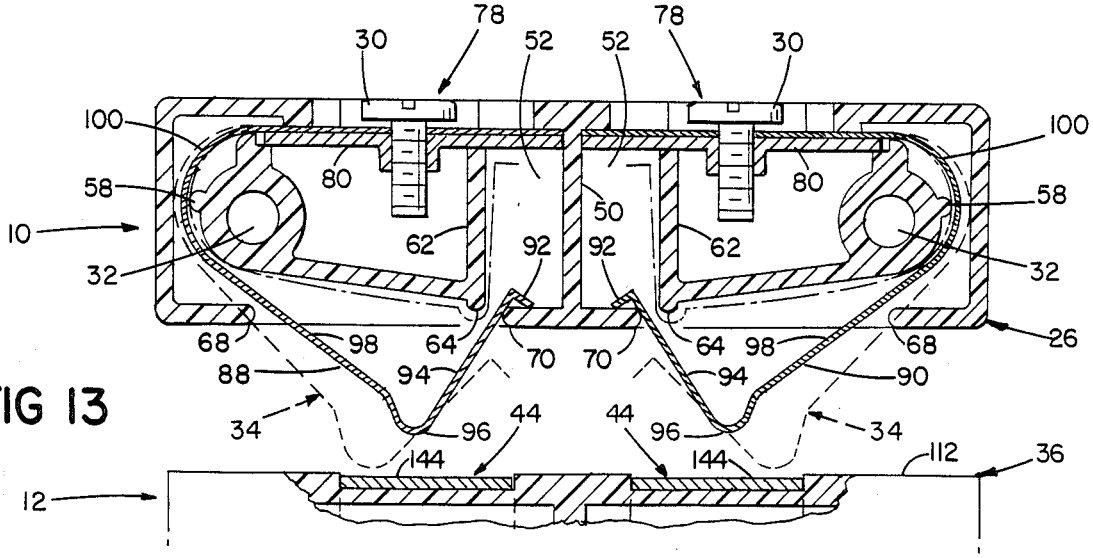
FIG. 13 is a sectional view of the first contact unit and a cooperating portion of the second contact unit in juxtaposed relation.

Further details of the contact assembly may be seen with reference to FIG. 7. Terminal plate 80 is a rectangular member that is about 0.8 centimeter wide, about 2.2 centimeters long and about 0.8 millimeter thick. Formed in plate 80 is threaded socket 82. Contact strip 34 is formed of phosphor bronze spring strip material that is about 0.4 millimeter thick and about 0.8 centimeter wide. Aperture 84 is formed in planar terminal portion 86 at one end of the spring strip. The other end of strip 34 is bifurcated and formed into two similar contact portions 88, 90, each of which has a width of about 0.35 centimeter. Restraining tip 92 of each contact portion 88, 90 has a length of about two millimeters and is disposed at right angles to planar portion 94 that has a length of about one centimeter. Contact surface 96 is in the form of a protruding knuckle, has an inside radius of about one millimeter and connects planar strip portions 94, 98 that are disposed at a right angle to one another. The surface of knuckle 96 projects about one millimeter above the plane of portion 98. The curved bights 100 of contact strip portions 88, 90 have radii of about 0.5 centimeter and connect the common planar base portion 86 with planar portions 98, portions 98 being disposed at an angle of about forty-five degrees to base 86 in unstressed condition (FIG. 13).

Figure 4:
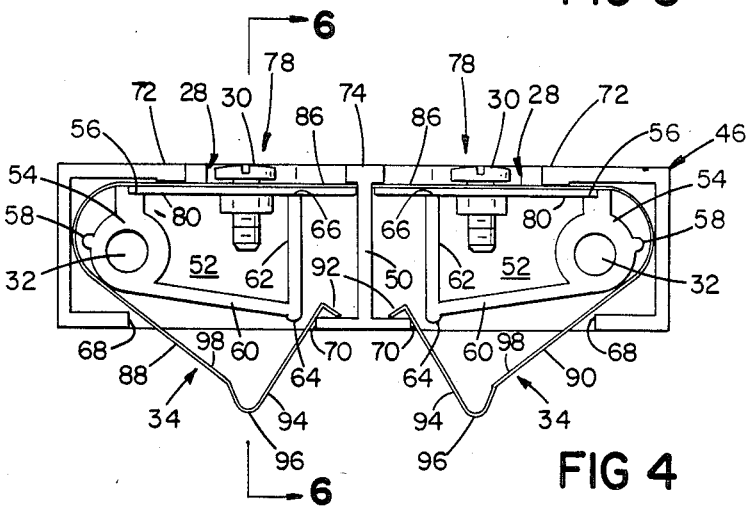
FIG. 4 is a side elevational view of the contact unit of FIG. 3 with its cover member removed.
Figure 5:
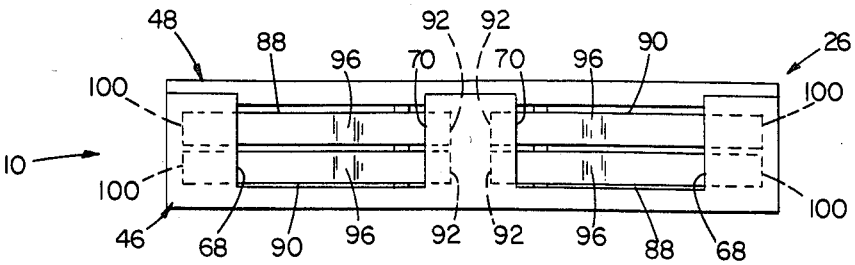
FIG. 5 is a bottom view of the contact unit of FIG. 3.

Each spring contact assembly 78 is received in its compartment 52 as indicated in FIG. 4 with contact plate 80 seated on surfaces 56, 66, spring portion 86 retained by wall surfaces 72, 74, portions 94, 98 protruding through the aperture between the surfaces 68 and 70 and tips 92 seated against the inner surface of flange 70 so that the contact strips are restrained and bights 100 are slightly prestressed. Cover 48 is welded to base 46 and retains the two contact assemblies 78 in their compartments 52.

Further details of unit 12 with fixed contacts may be seen with reference to FIGS. 8–12. The overall dimensions of the unitary molded housing 36 of unit 12 are about the same as unit 10, housing 36 having wall 106 in which two recesses 38 and connecting slot 108 are defined, adjacent sidewall 112 in which two rectangular recesses 110 are defined, and a third face 116 opposite sidewall 106 in which two similar aligned rectangular recesses 114 are defined. Each rectangular recess 110, 114 has a depth of about one millimeter and a width of about 1.3 centimeters. Molded in housing 36 at each end are posts 108 that define holes 42. Transverse webs 122, 124, 126 extend between sidewalls 106 and 116 and define two similar compartments 120. Formed in each compartment 120 are two support surfaces 128, 130. Tab 132 projects from the sidewall that defines surface 112 and a slot 134 extends through that sidewall.

Figure 12:
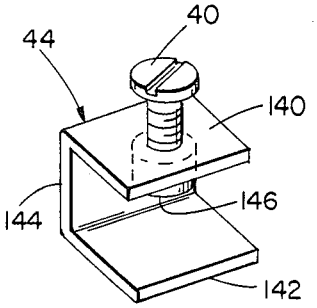
FIG. 12 is a perspective view of a contact assembly employed in the contact unit of FIG. 8.
Figure 8:
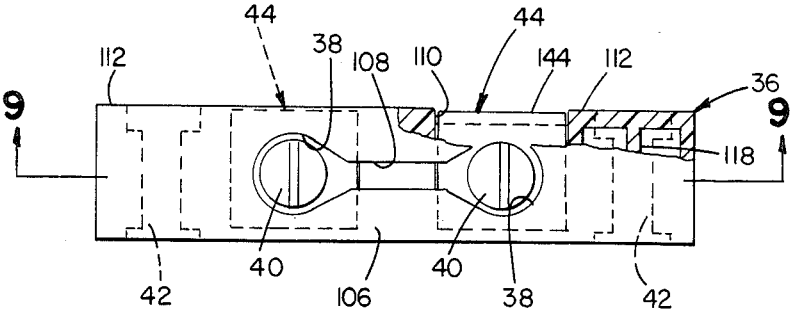
FIG. 8 is an elevational view of the second contact unit shown in FIG. 2 with a portion broken away.
Figure 11:
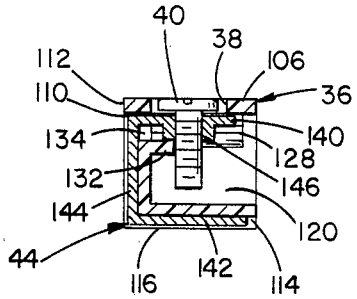
FIG. 11 is a sectional view taken along the line 11—11 of FIG. 9.
Figure 9:
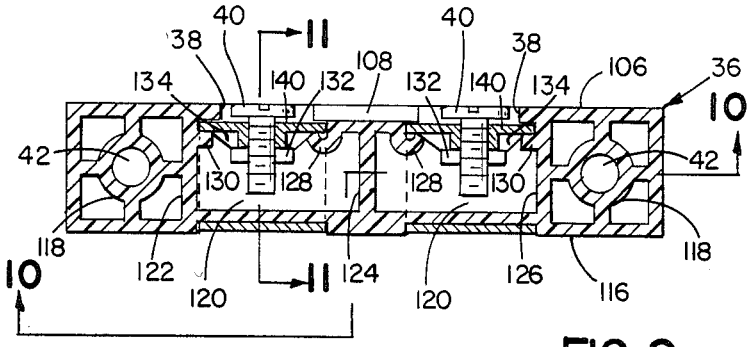
FIG. 9 is a sectional view taken along the line 9—9 of FIG. 8, showing a portion of the bottom of the second contact unit.

Each contact 44 is a strip of brass of about 0.6 millimeter thickness with two parallel flanges 140, 142 connected by a planar coupling portion 144, as indicated in FIG. 12. Formed in flange 140 is threaded coupling 146 that receives terminal screw 40. The brass strip has a width of slightly less than 1.3 centimeter. When flange 140 is inserted through slot 134 of its compartment 120, as indicated in FIGS. 8–11, flange 142 is received in recess 114 and coupling portion 144 is seated in recess 110. In that position, as indicated in FIG. 11, the outer surfaces of portions 142 and 144 are slightly below the plane of faces 112 and 116 respectively. Terminal screw 40, when threaded into coupling 146, cooperates with compartment tab 132 to fixedly attach the contact member 44 to the housing member 36 in a simple and secure manner with contact surfaces of flange 142 and connector portion 134 externally exposed and the head of the screw received in socket 38.

Contact unit 12 may be attached to a support surface so that contact surfaces of either flanges 142 or coupling portions 144 face the cooperating contact unit 10.

Figure 14:
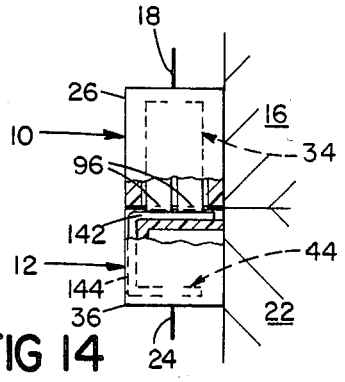
FIG. 14 is a view of the two contact units with portions broken away taken along the line 14—14 of FIG. 1.
Figure 10:
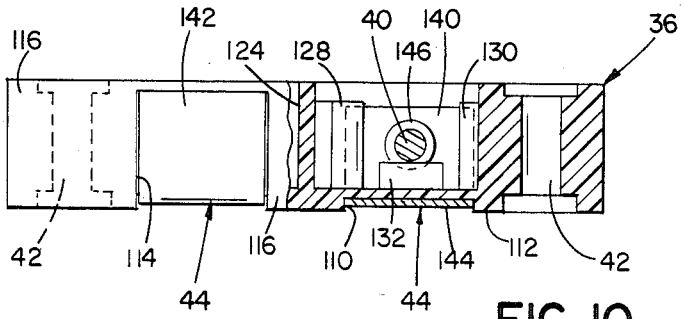
FIG. 10 is a sectional view taken along the line 10—10 of FIG. 9.

Further features of the contact units 10 and 12 may be seen with reference to FIGS. 13 and 14. The unstressed condition of spring contact 34 is indicated by the dashed line in FIG. 13. When the contact assemblies 78 are received in compartments 52, their restraining tips 92 are disposed beneath flanges 70, such that the bights 100 of the spring are prestressed as indicated. This restraining action also maintains the contact arms 94, 98 in place such that damage that might result from inadvertant backwards stress (for example, as a result of accidental abuse in day to day cleaning activities) is avoided. The contact knuckle surfaces 96 project from the housing 26 for alignment with contact surfaces 144 (or, in a second orientation of unit 12, with contact surfaces 142) of the cooperating contact unit 12.

As the contact units 10 and 12 are moved towards one another, each contact knuckle 96 of unit 10 engages the opposed contact surface 144 (142) of unit 12 and then slides laterally along surface 144 (142) in a wiping action until surface 112 (116) seats against the opposed surface of housing 26. Each spring bight 100 contracts until the bight engages projection 58, at which point spring resistance is increased. The inward movement of contact knuckle 96 also causes planar portion 94 to wipingly engage tip 64 of web 62, and further inward movement flexes portion 98 and provides further augmentation of contact spring resistance. These actions increase resistance to spring motion and impose greater contact force as the knuckle 96 moves across the planar fixed contact surface 144 (142) in wiping action so that a firm electrical connection is established between each contact 96 and the cooperating plate surface 144 (142). The recessed compartment wiping surface tips 64 allow contact strips 34 to be depressed beyond that plane of housing 26 such that the cooperating contact surfaces remain resiliently engaged even when the juxtaposed surfaces of the two housings 26, 36 are fully engaged, thus avoiding damage to contact surfaces.

After the contact units 10, 12 are mounted on members of the structural opening to be monitored (for example, the doorway shown in FIG. 1), connector wires 18, 24 are attached to terminal screws 30, 40 with the wires extending along the elongated portion 27, 108 and being secured under the screw heads and contained by the surrounding recess walls. The position of the contact units 10, 12 when door 14 is closed is shown in FIGS. 1 and 14, the contact units in that position completing an electrical circuit between foil conductor 20 and monitor circuit conductors 24.

While a particular embodiment of the invention has been shown and described, various modifications will be apparent to those skilled in the art, and therefore it is not intended that the invention be limited to the disclosed embodiment or to details thereof and departures may be made therefrom within the spirit and scope of the invention.

What is claimed is:

1. A device for use in a security system for monitoring a structural opening such as a door or a window comprising a housing of electrically insulating material, an elongated electrically conductive member, means fixing one end of said conductive member to said housing with an intermediate portion of said conductive member protruding through an opening in said housing, said intermediate portion including first and second portions angularly offset from one another and having a contact surface at the junction of said first and second portions for engagement by an electrically conductive actuator, and structure in said housing adjacent said second portion for wipingly engaging and flexing said second portion as said contact surface is moved towards said housing to increase the resistance of said conductive member to flexing movement, thereby increasing the pressure at said contact surface between said conductive member and said actuator.

2. The contact unit of claim 1 and further including means to maintain said conductive member in prestressed condition.

3. The contact unit of claim 1 wherein said housing has in one face a recess that has a cylindrical portion and a relatively narrow elongated portion that extends away from said cylindrical portion, and further including a connector member of the screw type and tnat has an enlarged head portion disposed in said cylindrical portion of said recess such that a connector component secured under said screw head is guided by and contained within said cylindrical recess wall that extends around the perimeter of said screw head, with said relatively narrow elongated portion providing supplemental guidance for the conductor of said connector component.

4. The contact unit of claim 1 wherein said conductive member is of the spring strip type and has first and second legs connected by a bight.

5. The contact unit of claim 4 wherein one leg of said spring strip is bifurcated and defines said intermediate portion of said conductive member.

6. The contact unit of claim 1 wherein said first and second portions of said intermediate portion are disposed at about right angles to one another and said contact surface is a radiused knuckle portion.

7. The contact unit of claim 1 wherein a tip portion of said conductive member is in restrained engagement with fixed housing structure, providing effective prebiasing of said conductive member and protection against excessive stress as a result of routine cleaning activities and the like.

8. The contact unit of claim 7 wherein said conductive member is of the spring strip type and is disposed in a compartment of said housing with said one end fixedly connected to a terminal screw, said spring strip having first and second legs connected by a bight, said bight extending around post structure in said housing, one leg of said spring strip being bifurcated and defining said intermediate portion of said conductive member, said first and second portions of said intermediate portion being disposed at about right angles to one another and said contact surface being two aligned radiused knuckle portions.

9. A security interface system for monitoring a structural opening such as a doorway or window that includes a first contact unit for mounting on a fixed part of the structural opening and a cooperating second contact unit is mounted on a movable member adapted to close the structural opening so that the two contact units are adjacent one another and complete an electrical circuit when the opening is closed by the movable member, one of said contact units comprising a housing of electrically insulating material that defines two compartments, each said compartment having a first opening on one side of said housing for a terminal connection, a second opening on the opposite side of said housing, structure in said compartment defining a post and a wiping surface spaced from said post, two electrically conductive spring strips, each said spring strip having first and second legs connected by a bight, said second leg having first and second portions angularly offset from one another and having a contact surface at the junction of said first and second portions for engagement by an electrically conductive actuator of a cooperating contact unit, each said spring strip being disposed in a corresponding compartment of said housing with said first leg adjacent said first opening, said second leg adjacent said second opening with said contact surface outside said housing, said second portion adjacent said wiping surface, and said bight extending around said post structure, means to connect each said first leg to external circuitry, said second leg being proportioned so that as said second leg is flexed toward said housing, said second portion comes into engagement with said wiping surface such that the resistance to movement of said second leg is increased; and the other of said contact units comprising two contact members of electrically conductive material, each said contact member having two parallel flanges connected by a planar coupling portion, a housing of electrically insulating material, said housing defining two compartments and having two planar exterior walls disposed at right angles to one another, each said planar exterior wall having two recesses therein and a third exterior wall having an opening for a terminal connection, each said compartment having a slot through the planar exterior wall adjacent said third wall that communicates with a said recess in said adjacent planar wall, each said slot receiving one of said flanges of a corresponding one of said contact members so that said one flange is disposed in said compartment adjacent said opening, the other flange is disposed in a recess in the one of said planar walls spaced from said third wall and said planar coupling portion is disposed in a recess in said adjacent planar wall, the outer surfaces of said other flange and said coupling portion of each said contact member being slightly below the plane of the faces of said planar walls, and terminal connection means disposed in said opening for connecting said one flange of each said contact member to external circuitry, said terminal connection means cooperating with structure in each said compartment to fixedly attach each said contact member to said housing member, the fixed surfaces of the contact members of said other contact unit being spaced for alignment with corresponding contact surfaces of said two spring strips of said one contact unit so that an electrical circuit is completed between said terminal connections when said opening is in said closed position.

10. The system of claim 9 wherein said second leg of each said spring strip is bifurcated.

11. The system of claim 10 wherein said first and second portions of each said second leg are disposed at about right angles to one another and each said contact surface is a radiused knuckle portion.

12. The system of claim 9 wherein a tip portion of each said spring strip is in restrained engagement with fixed structure in the housing of said one contact unit, providing effective prebiasing of said spring strips and protection against excessive stress as a result of routine cleaning activities and the like.

13. The system of claim 12 wherein said second leg of each said spring strip is bifurcated, said first and second portions of each said second leg are disposed at about right angles to one another and each said contact surface is a radiused knuckle portion.

14. The system of claim 13 wherein each said housing has two terminal connection means receiving recesses, each said recess having a cylindrical portion and a relatively narrow elongated portion that extends away from said cylindrical portion, and a connector member of the screw type that has an enlarged head portion disposed in said cylindrical portion of said recess such that a connector component secured under said screw head is guided by and contained within said cylindrical recess wall that extends around the perimeter of said screw head, with said relatively narrow elongated portion providing supplemental guidance for the conductor of said connector component.

* * * * *